US005488772A

United States Patent [19]

Dababneh et al.

[11] Patent Number: 5,488,772

[45] Date of Patent: Feb. 6, 1996

[54] COLLECTOR NAIL CLIPPER

[76] Inventors: Awwad Dababneh; Maggie Dibbini, Mt. Healthy 7504 Perry, Cincinnati, Ohio 45231

[21] Appl. No.: 192,254

[22] Filed: May 4, 1994

[51] Int. Cl.[6] ..... A45D 29/00

[52] U.S. Cl. ..... 30/28; 132/75.5; 30/125

[58] Field of Search ..... 30/28, 26, 125; 132/75, 75.5

[56] References Cited

U.S. PATENT DOCUMENTS

| | | | |
|---|---|---|---|
| 3,169,312 | 2/1965 | Fink | 30/28 |
| 4,614,031 | 9/1986 | Chen | 30/28 |
| 4,640,011 | 2/1987 | Gamble | 30/28 |
| 4,940,136 | 7/1990 | Miller et al. | 30/28 |
| 4,996,771 | 3/1991 | Williams | 30/28 |
| 5,131,146 | 7/1992 | Leininger | 30/28 |
| 5,195,544 | 3/1993 | Campagna | 30/28 |
| 5,261,160 | 11/1993 | Castagna | 30/28 |

*Primary Examiner*—Rinaldi I. Rada
*Assistant Examiner*—Allan M. Schrock

[57] ABSTRACT

A u-channel nail clipping catcher case is provided herein for use with nail clipper, the case is made of rubber (elastic). It includes a floor, two side walls, back end, partial ceiling and a small lip at each top end of the walls. A new clipper design is introduced. It eliminate the use of the center pin in the regular design and uses a sliding pivot into slots within the side walls. The new design is to be used with the mentioned rubber catcher. Modifications on the regular nail clipper design are suggested to adopt the new catcher and achieve effective clipper catcher combination.

1 Claim, 4 Drawing Sheets

COLLECTOR NAIL CLIPPER

BACKGROUND OF THE INVENTION (i) Field of the Invention

This invention relates to nail clippers particularly the type which retains nail clippings during the process of clipping.

(ii) Description of Prior Art

U.S. Pat. No. 3,169,312 issued Feb. 16, 1965 to C. H. Fink under the title of GUARD FOR NAIL CLIPPER. Mr. Fink's invention is specifically directed toward a novel guard mountable on conventional nail clippers so to assist in the collection of cut nails.

U.S. Pat. No. 4,614,031 issued Sep. 30, 1986 to Steve Y. Chen. A nail clipper comprising a stationary base having structure defining a nail depository, a rear base end and forward base end that terminates into a base jaw having a convexed base cutting edge. A pair of a parallel tapering side walls are integrally bound to the stationary base. Each of the side walls include a back wall end and a front wall end having a top formed with a side wall recess seat. A resilient cover plate has a rear cover end bound to the rear base end and forward cover end that terminates into a cover jaw. The cover jaw includes a convexed cover cutting edge that is capable of engaging the base cutting edge when the resilient cover plate is depressed.

U.S. Pat. No. 4,640,011 issued Feb. 3, 1987 to William Gamble. The invention contemplates a single-piece clipping retainer having snap-action assembly to a conventional nail clipper, of the variety in which elongate jaw members are connected at one end and diverge toward their other end. The retainer comprises a mounted end and an actuable end, with an integrally formed hinge connection there between. The actuable end has side panels to close the sides of the space between jaw members when releasably retained in its up position when the actuable end is released and downwardly hinged, the open sides of the space between the jaw members is exposed for the purpose of disposing the clipping.

U.S. Pat. No. 4,940,136 issued Jul. 10, 1990 to Miller and Brown. A finger nail clipper pouch for the use with a key ring or like is disclosed as including an elongated one-piece receptacle formed of resilient and flexible material. The receptacle includes an interior compartment generally configured to the shape of the nail clipper, one end of the receptacle being open for the entry and removal of the nail clipper. The closed end is attached to the key ring while the open end has a restricted throat opening that is capable of being resiliently enlarged when the receptacle is temporarily deformed by squeezing thereof to facilitate removal of the nail clipper from the receptacle.

U.S. Pat. No. 4,996,771 issued Mar. 5, 1991 to Craig Williams. A nail clipper retainer is provided and consists of a mechanism for catching nail clippings and a structure for slideably attaching the catching mechanism to a body of a nail clipper. When the catching mechanism is in a forward position on the clipper it will catch the clipping. When the catching mechanism is in a rearward position on the clipper it will allow the clippings to be emptied therefrom.

U.S. Pat. No. 5,131,146 issued Jul. 21, 1992 to Kent Leininger. A finger/toe nail clipper receptacle is disclosed which receives a finger/toe nail clipper and contains the clippings. This Receptacle has a rear sleeve which receives a rear portion of the nail clipper and a front shield that receives the front portion of the clipper for containing the clippings. The front shield is attached to the rear sleeve by a live hinge which allows the front shield to be pulled away from the front portion of the clipper pivoting about the hinge, thereby releasing the clippings.

U.S. Pat. No. 5,195,544 issued Mar. 23, 1993 to Vince Campagna. A hollow nail catcher case, the case is preferably constructed of thin synthetic plastic material. It is constructed as a hollow truncated pyramid for sliding over the nail clipper. It is claimed that the case could be universally usable in many different kinds of nail clippers.

U.S. Pat. No. 5,261,160 issued Nov. 16, 1993 to Castagna. A nail clipper with catcher comprises a bottom container, a resilient top plate having connection at a rear end of the container to urge the top plate away from the container, the container having an upturned cutting edge at a front end of the container, the plate having a downturned cutting edge opposite to the upturned cutting edge, and a lever having a bent end portion with a shaft which engages a post mounted on the container for moving the plate up and down to clip nails, which clipping fall into the container. The shaft also forms a hole in the bent portion of the lever. A protrusim is provided on each side of the opening in the top plate. The lever is rotatable into three position. In a closed position, the two cutting edges are touching so the clipping container is closed, in the clipping position, the cutting edges are spaced form each other sufficient distance to allow nails in to be clipped. In the emptying position, a relatively large spacing between the two cutting edges is provided allowing clipping to be emptied.

SUMMARY OF THE INVENTION (i) Aims of the Invention

All of the pervious described inventions are subject to failings due to one or more of the following problems:

Non economical, using too many parts and or complicated parts which are expensive to make.

Complicated operation, people are used to the regular nail clipper which is very popular and easy to use by all ages. Complicated designs are not acceptable by the public therefor not marketable.

Functional failure; nail clippings are tend to be trapped between the cutting edge and the center pin (the clipping lever pivot pin in the regular design), because there is not enough space between the side walls of the retaining device and the lower and upper parts of the jaw. This conflict with the idea of collecting the clippings in the back space (after the pin away from the cutting edge) of the clipper. Invention 4,614,031 tried to solve this problem by eliminating the center pin and adapting a new mechanism, unfortunately the design is non economical and deviates from what the public have been used to.

Accordingly the objectives of this invention are to introduce designs of a nail clipper with a catcher which are economical, practical and easy to use, and one does not need an instruction manual to operate.

(ii) Statement of the Invention

This invention introduces two different clipper designs and one new catcher concept. Both the two designs are utilizing the same catcher concept.

The catcher is made of rubber (elastic). The basic shape of the catcher is a U-chanel, it consist of a floor and two walls. It has one open end where the cutting edge would be placed when assembled to the nail clipper and a closed end where the other end of the clipper would fit. When assembled to a clipper the floor of the rubber catcher will be under the lower part of the cutting edge. The walls of the catcher will each seal one side of the clipper. Nail clippings will be collected in the space formed between the upper and lower members of the cutting jaw and the two walls of the catcher. Each wall has a lip at the top end of it. In the neutral position (before being assembled to the catcher) the two walls are not perpendicular to the floor of the catcher. They are inwardly inclined with a small degree, when assembled to the clipper the two walls will stretch open until the clipper is placed in, then the two walls are released to come to a rest at the side edges of the members of the jaw keeping it sealed all the time. The nail clipper will set tight between the floor of the catcher and the lips of the walls and the closed end of the catcher. To empty the clippings, the catcher is simply peeled of the nail clipper by stretching its' walls wide open.

Other aspects of the rubber catcher are, it serves as cushion handle and gives better grip on the clipper. Also, the outer surface of the catcher could take decorative shapes and colors which make it more attractive than the plain nail clipper.

THE FIRST CLIPPER DESIGN to be used with the rubber catcher consist of a cutting jaw which is formed from the upper and lower cutting edges. At one end both jaw elements are joined together and at the other end is the sharp cutting edge. The cutting jaw could also be made of one piece only. In either cases the cutting jaw has a spring action, it will stay open unless forced to close and by removing the closing force the jaw will be open again. The clipper consist also of two partial "small" walls coming out from the lower element of the cutting jaw, there is one wall on each side of the lower cutting element, the walls are perpendicular to the plane of the lower cutting element and is attached to it. The walls are spaced enough to allow free movement of the upper element between them. The walls are extended higher than the upper element, just enough to have a small slot to mount the clipping lever. The wall width would be around one third of the total length of the clipper. The slot is open on the back side of the wall away from the cutting edge, the slot is shaped like an angle with one horizontal long side and a relatively short and vertical side. The short side of the slot is semicircular in shape. The slot width is proportioned to the clipping lever shaft which is around ⅛", the length of the slot is around two third of the total width of the side wall. The last part of the clipper is the clipping lever, it is a flat piece of metal sheet, almost rectangular in shape it has a slight bend at one end, also at the same end a small shaft is welded in a way where the center line of the shaft is parallel to the plane of the rectangular piece and is perpendicular to the longitudinal axis of the same piece. The shaft extends more than the width of the rectangular piece, at each end of the shaft there is an under cut of the thickness of the side wall. These under cuts are designed to fit into the slots and by pushing it all the way into the slot the slipping lever is assembled to the cutting jaw. At the open end of the slot the shaft slides easily and by the middle of the slot the upper jaw element will touch the shaft and start forcing it up, by the end of the slot the upper element will push the shaft up into the vertical part of the slot. The lever could be assembled into two positions, if the bend of the lever is pointing downward the clipper is in the clipping mode if the bend of the lever is pointing upward the clipper is in the storage mode.

THE SECOND CLIPPER DESIGN which will work efficiently with the rubber catcher is very similar to the regular design. As mentioned earlier patents which tried to design a catcher to fit the regular clipper design without any changes have not succeeded. In all cases clippings will get stuck between the cutting edge and the center pin (pivot). In this design considerations are made to modify the regular clipper design in order to achieve an efficient combination of a nail clipper and a catcher. The goal here is to make it easier on the clippings to flow around the center pin and get to the back of the collecting space. This is done by creating more room around the center pin. Three things are suggested, by increasing the width of the clipper, by locating the center pin further to the back and by increasing the depth of the nail clipper. One or a combination of these techniques can be used to achieve the goal and keep the nail clipper as small as possible.

BRIEF DESCRIPTION OF THE DRAWINGS

Other objects, features and advantages of the invention will be apparent from the following Description of the Preferred Embodiment taken together with the accompanying drawings in which.

DESCRIPTION OF THE PREFERRED EMBODIMENT

Figure 1:
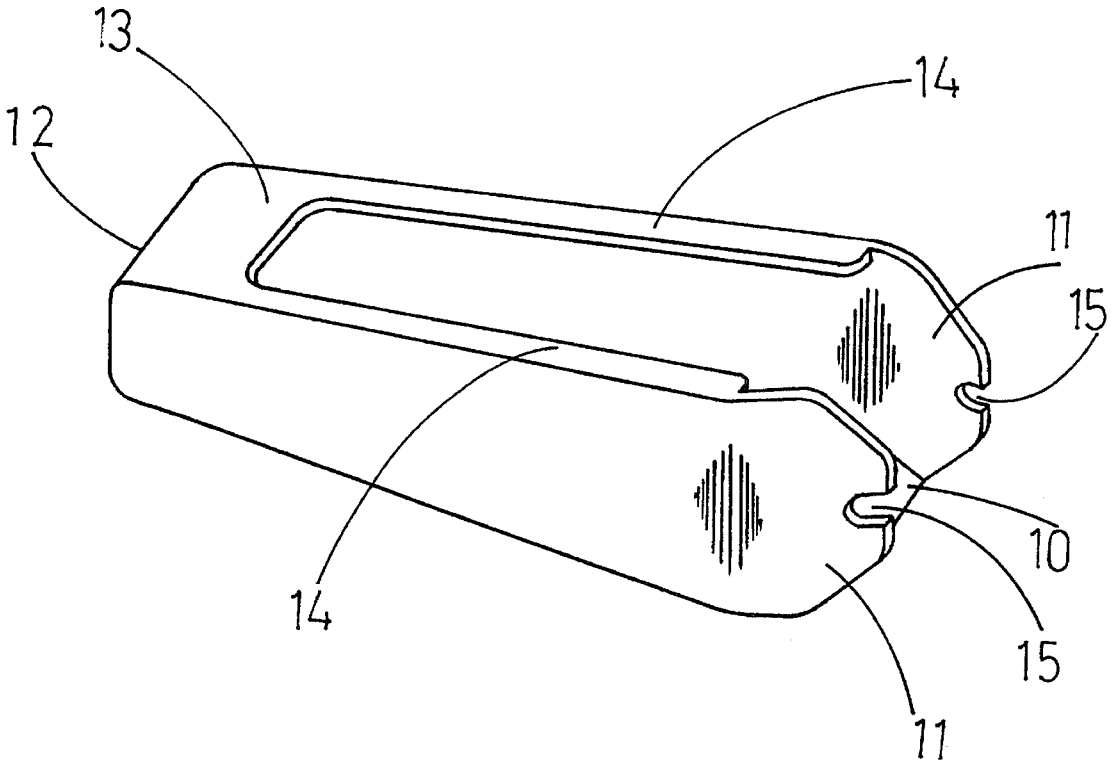
FIG. 1 is an isometric view of the rubber catcher.

FIG. 1 shows an isometric view of the rubber catcher. The basic shape is a u-chanel with a closed back end 12. The catcher has one floor 10 and two side walls 11. At the back end there is a partial ceiling 13 which gives the catcher more strength and structure. At each top end of the walls there is a horizontal lip 14. When the clipper is assembled to the catcher it will sit inside the channel and the horizontal lip 14. When the clipper is assembled to the catcher it will sit inside the channel and the horizontal lips will be on top of the cutting jaw. In the front end there is a cut 15 in each wall. These cuts are on the same level of the opening of the cutting jaw. The function of these cuts is to allow nails to enter the cutting jaw from the side. The catcher detailed shape will take the shape of the matched clipper but the basic shape and embodiment will not change.

Figure 2:
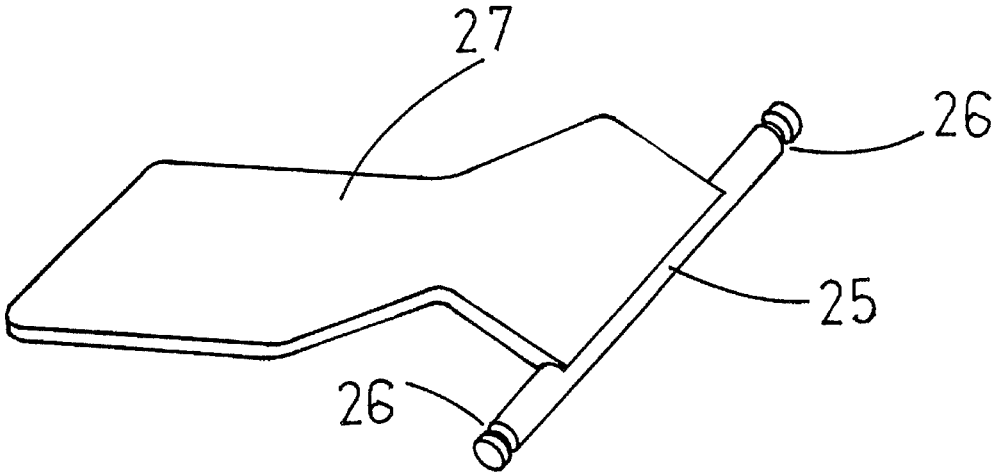
FIG. 2 is an isometric view of the clipping lever of the first design.

FIG. 2 is an isometric view of the clipping lever of the first design, the basic embodiment are the handle 27 and the pivot 25, the pivot 25 is welded to the handle 27. At each end of the pivot there is a groove 26 that goes around the shaft center.

Figure 3:
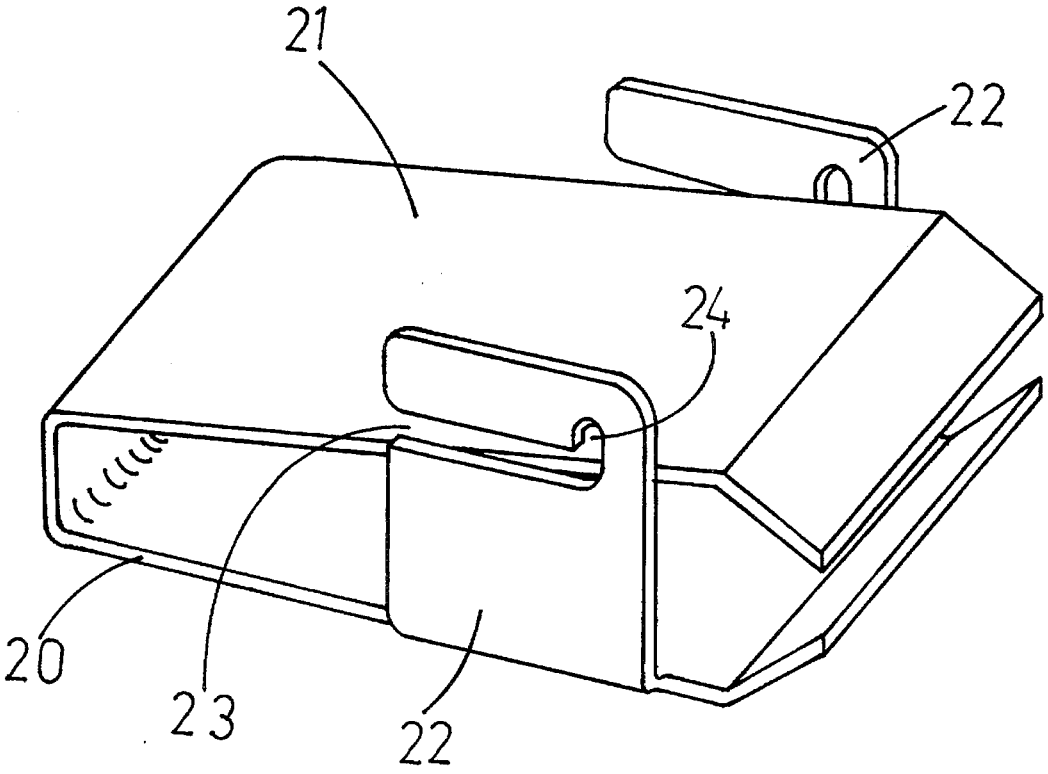
FIG. 3 is an isometric view of the cutting jaw of the first design.

FIG. 3 is an isometric view of the cutting element of the first design. The basic embodiment are the upper piece 21 of the cutting jaw, the lower piece 20 of the cutting jaw, two partial walls 22, one on each side of the cutting jaw. The walls 22 are side extension coming out of the lower piece 20 of the cutting jaw, they are attached to it, but the upper piece 21 is free to move between the two walls 22. A slot 23 is made in each wall, at the end of the slot there is a round extension 24 that goes vertically.

Operation of the clipper in the first design:

The clipping lever is assembled to the cutting jaw by putting the pivot 25 in the slots 23 in a way that the groves 26 will fit one in each slot. As the pivot 25 is pushed inward the upper piece 21 is pushed downward until the end of the slots 23 where the upper piece 21 will push the pivot 25 up to set in the slot extension 24. Now, according to the position of the handle 27 here are two modes of function, if the handle is concaved down that means the clipper is in the cutting mode if the handle 27 is flipped over and became concaved up the clipper will not be in the cutting mode.

Figure 4:
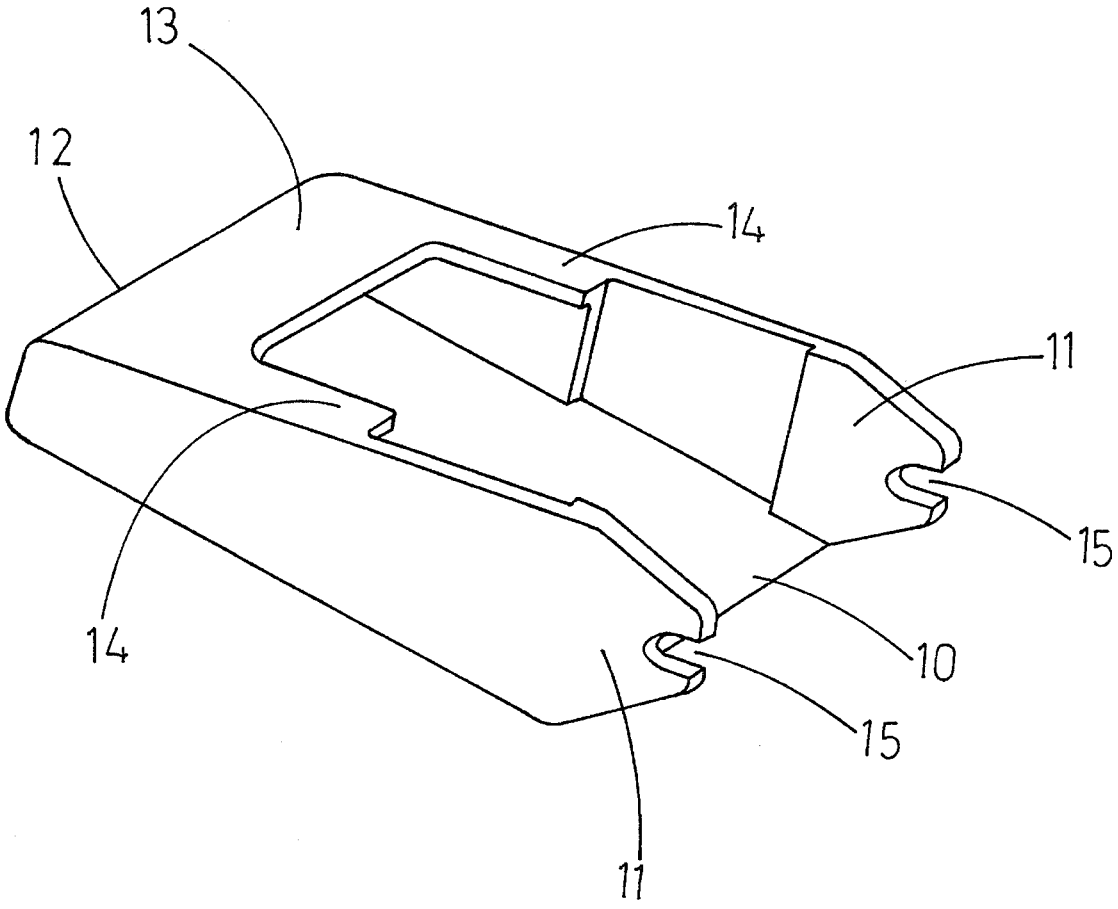
FIG. 4 is an isometric view of the rubber catcher used with the first clipper design.

FIG. 4 is an isometric view of another rubber catcher. The same said on FIG. 1 applies. Note that the inner shape of the rubber catcher took the shape of the cutting jaw and the side walls, but the basic embodiments are still the same.

Figure 5:
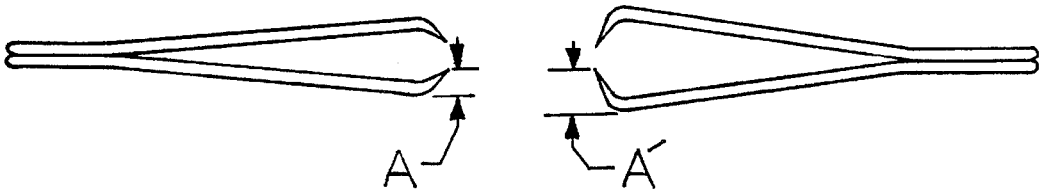
FIG. 5 shows the difference between regular clipper design and the modified depth design.

FIG. 5 is an elevation view of a regular design clipper jaw and the modified design clipper jaw. This view explains the term deeper nail clipper. Note the distance A and A'; A is regular and A' is modified. A' is bigger than A.

Figure 6:
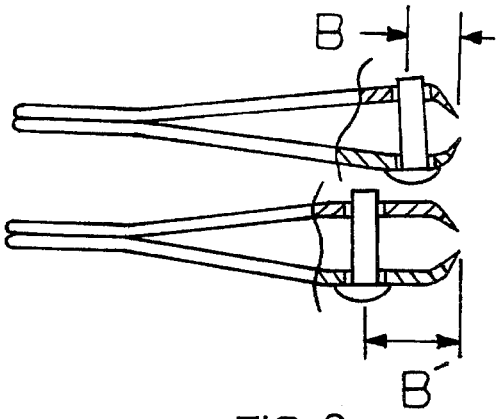
FIG. 6 shows the difference between regular clipper design and the modified center pin location design.

FIG. 6 is an elevation view of a regular design clipper jaw and the modified design clipper jaw. This view explains the term relocating the center pin. Note the distance B and B'; B is regular and B' is modified. B' is bigger than B.

Figure 7:
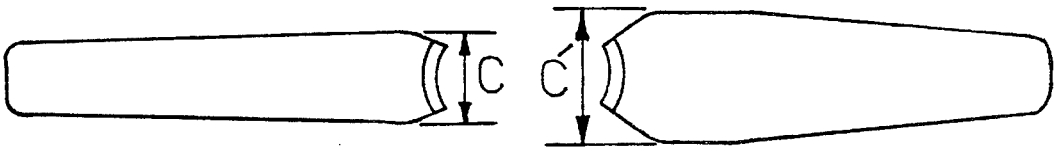
FIG. 7 shows the difference between regular clipper design and the modified width design.

FIG. 7 is a top view of a regular design clipper jaw and the modified design clipper jaw. This view explains the term increasing the clipper width. Note the distance C and C'; C is regular and C' is modified. C' is bigger than C.

The rubber catcher will work efficiently with the modified regular nail clipper design.

We claim:

1. A nail catcher comprising a nail clipper which includes upper and lower nail clipping members each having a first and a second end, said first ends being fastened together to form a bifurcated portion, said second ends forming spaced-apart jaws in an opposing relationship to each other, said nail clipper including two opposing partial side walls attached to the lower member spaced to allow free movement of the upper member, each side wall having an L-shaped slot, said nail clipper further including a clipping lever having a rectangular metal handle with a bend at at one end and a pivot member mounted at said one end, said pivot member having two ends, each end having a circumferential groove which fits in one of the L-shaped slots; and a rubber U-shaped catcher having a floor, two side walls each having a small lip, a closed end, and a ceiling.

* * * * *